US008779262B1

(12) United States Patent
Steinberger

(10) Patent No.: US 8,779,262 B1
(45) Date of Patent: Jul. 15, 2014

(54) CAPO

(71) Applicant: Richard Ned Steinberger, Nobleboro, ME (US)

(72) Inventor: Richard Ned Steinberger, Nobleboro, ME (US)

( * ) Notice: Subject to any disclaimer, the term of this patent is extended or adjusted under 35 U.S.C. 154(b) by 60 days.

(21) Appl. No.: 13/646,878

(22) Filed: Oct. 8, 2012

(51) Int. Cl.
*G10D 3/00* (2006.01)
*G10D 3/04* (2006.01)

(52) U.S. Cl.
CPC ..... *G10D 3/043* (2013.01)
USPC ..... 84/318

(58) Field of Classification Search
CPC ..... G10D 3/043
USPC ..... 84/318
See application file for complete search history.

(56) References Cited

U.S. PATENT DOCUMENTS

| | | | | | |
|---|---|---|---|---|---|
| 406,193 | A | | 2/1892 | Dahlman | |
| 4,143,576 | A | * | 3/1979 | Nichols et al. | 84/318 |
| 4,583,440 | A | * | 4/1986 | Powell, Jr. | 84/318 |
| D365,118 | S | * | 12/1995 | Kyser | D17/20 |
| 5,492,045 | A | | 2/1996 | Roblee | |
| D372,259 | S | * | 7/1996 | Kyser | D17/21 |
| D378,825 | S | * | 4/1997 | Dunlop | D17/20 |
| 5,623,110 | A | * | 4/1997 | Hoglund et al. | 84/318 |
| 6,008,441 | A | * | 12/1999 | Steinberger | 84/318 |
| 6,528,711 | B1 | * | 3/2003 | Paige | 84/318 |
| D533,211 | S | * | 12/2006 | Kyser | D17/20 |
| D573,629 | S | * | 7/2008 | Steinberger | D17/20 |
| 7,511,208 | B1 | * | 3/2009 | Kyser | 84/318 |
| 7,566,824 | B2 | * | 7/2009 | Small | 84/318 |
| 7,745,710 | B2 | * | 6/2010 | Campling | 84/318 |
| 7,932,450 | B2 | * | 4/2011 | Chen | 84/318 |
| 7,939,736 | B2 | * | 5/2011 | Campling | 84/315 |
| 7,968,778 | B2 | | 6/2011 | D'Addario | |
| 2010/0154616 | A1 | * | 6/2010 | Campling | 84/318 |
| 2010/0269666 | A1 | * | 10/2010 | D'Addario et al. | 84/318 |

* cited by examiner

*Primary Examiner* — Robert W Horn
(74) *Attorney, Agent, or Firm* — Saul Epstein

(57) ABSTRACT

A spring operated capo that includes two jaws with graspable handles and a spring that urges the two jaws to close on the neck of a stringed musical instrument. The spring exerts a force on the two jaws with a lever arm that decreases as the jaws open.

12 Claims, 6 Drawing Sheets

Fig 7
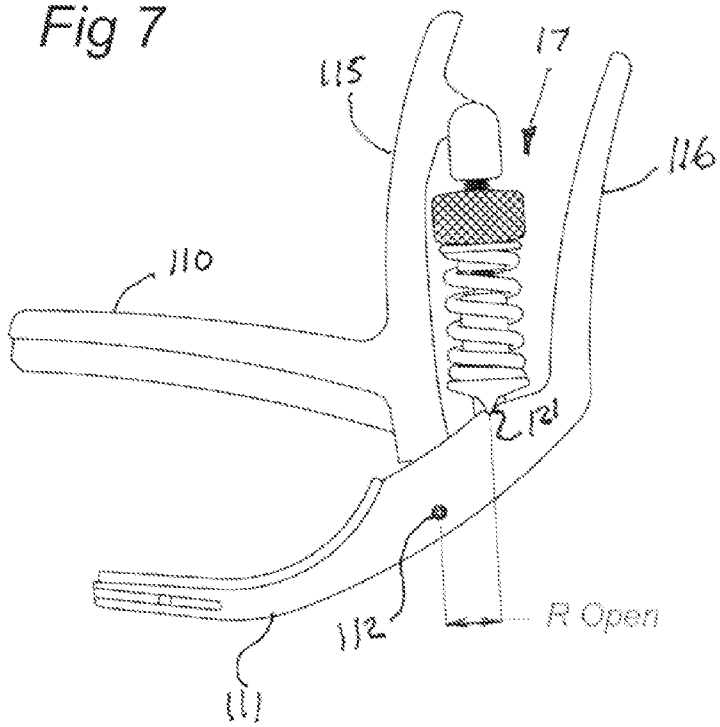
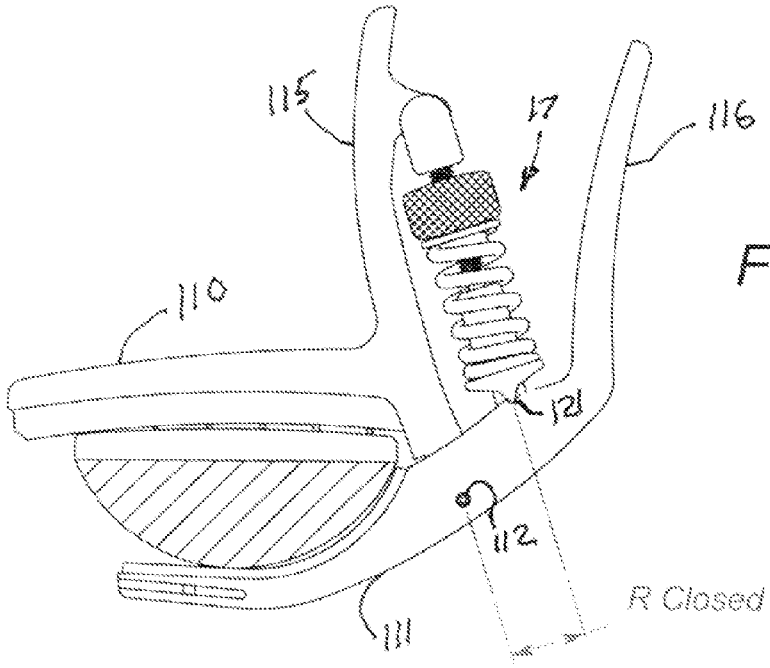
Fig 8

CAPO

RELATED APPLICATIONS

This application claims the benefit under 35 USC §119(e) of the filing date of U.S. Provisional Patent Application No. 61/627,790 entitled "CAPO" and filed on Oct. 18, 2011.

BACKGROUND OF THE INVENTION

A capo is a device for clamping the strings of a stringed musical instrument, such as a guitar, against the fretboard of the instrument neck in order to alter the (unfingered) pitches produced by the strings. Ordinarily, a capo is clamped between the frets along the fretboard so that the effective string lengths are determined by the adjacent fret, and the strings will produce the notes corresponding thereto.

In the past, capos have utilized various means for attaching the device to the instrument neck, including screws, levers, cams, and spring-loaded clamps, as well as other means. Spring-loaded clamps have become popular because they can be opened and rapidly moved to a new position using only one hand. This makes manipulation during a performance practical. However, one problem with prior art spring-loaded capos is that they require more hand force to open than is desirable, and it can be difficult to keep the capo open, as required, to reposition it over the strings.

As noted above, spring-loaded capos are well known, and have been described in many U.S. patents, for example, in U.S. Pat. No. 4,583,440, Powell, Jr., U.S. Pat. No. 6,008,441, Steinberger, U.S. Pat. No. 6,528,711, Paige, U.S. Pat. No. 7,566,824, Small, U.S. Pat. No. 7,745,710, Campling, and U.S. Pat. No. 7,968,778, D'Addario and Steinberger.

SUMMARY OF THE INVENTION

The invented device is a spring-loaded capo for use on the neck of a stringed musical instrument. The capo jaws are joined by a pivot, and the instrument neck is held as by the action of the jaws of a pair of pliers, using spring force. Handles attached to the jaws are accessible to the musician so as to permit him or her to easily reposition the capo, including during a performance. The term "pivot" as used in this document is used to describe any means for constraining motion to be rotary, for example a pin in a hole, a male/female "V" connection, a leaf, etc.

Ordinarily, in a spring-loaded capo, the force required to open the capo increases as the jaws are opened since, as a spring is compressed, the force it exerts increases. And ordinarily, the increase in force is in proportion to the increase in spring compression. In the invented capo, however, the mechanism is arranged so that the increase in capo opening force is less, proportionally, than the increase in spring force. The capo opening force can even be made to go down as the capo is opened.

The foregoing is accomplished by causing the path of the spring force to change with jaw position such that as the capo is opened, the path moves closer to the pivot that holds the jaws together. That is, the lever arm at which the spring acts gets smaller as the jaws open. The closing moment created by the spring force as the capo is opened is, therefore, less than it would have been had the path of the spring force remained fixed with respect to the pivot. This results in a reduced effort on the part of the musician to open the capo, and accordingly, makes repositioning the capo during a performance easier.

BRIEF DESCRIPTION OF THE FIGURES

FIG. 7 is a side view of a second embodiment of the invention, shown in an open position.

FIG. 8 is a side view of the second embodiment of the invention, shown closed, with the neck of an instrument shown clamped between its jaws.

DETAILED DESCRIPTION OF THE INVENTION

Figure 1:
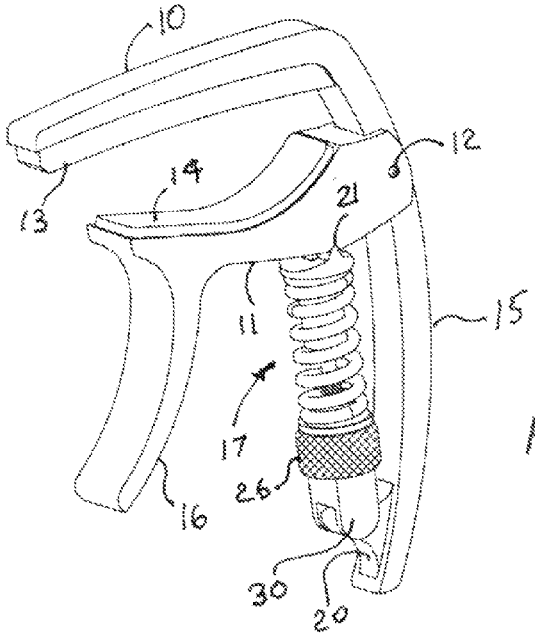
FIG. 1 is a perspective view of a first embodiment of the invented capo.
Figure 2:
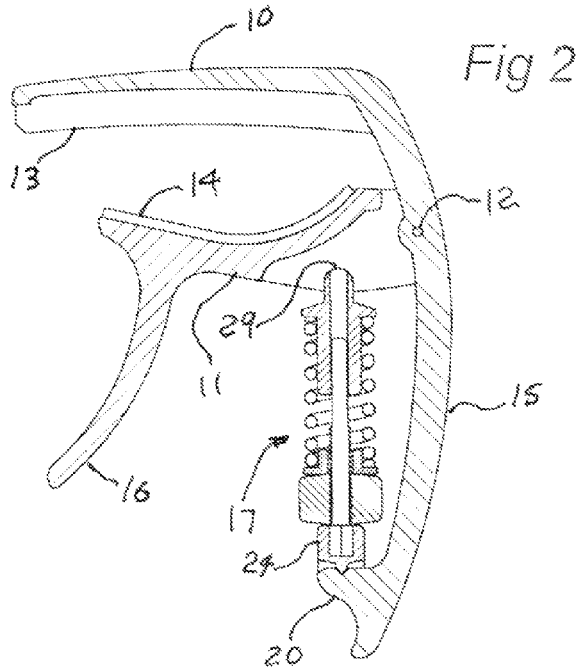
FIG. 2 is a cross sectional view of the first embodiment, taken at 2-2 of FIG. 3.
Figure 3:
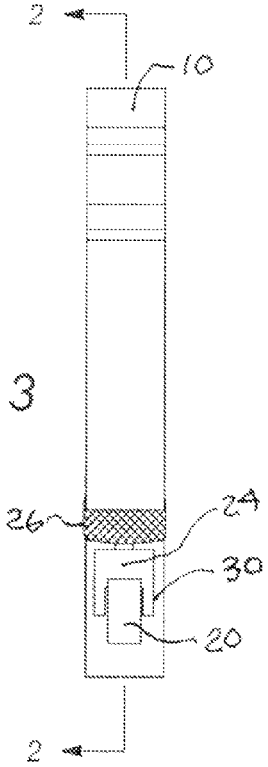
FIG. 3 is an end view of the first embodiment of the invention.

FIG. 1 shows a perspective view of a first embodiment of the invention, where fixed jaw 10 is shown connected to movable jaw 11 with a pivot 12. The terms "fixed" and "movable" are, of course, arbitrary relative terms, and are used here only for ease of explanation of the illustrated embodiments. Neither jaw is "fixed" in any absolute sense of the word. The "fixed" jaw, for purposes of this explanation, is the jaw that presses against the strings, and the "movable" jaw is the jaw that presses against the back of the instrument neck. This convention might not be so apt in other embodiments, but the uniform convention facilitates explanation here.

The jaws are preferably covered with plastic or the like pads 13 and 14 that prevent marring of the instrument with which the capo is used. There are many suitable materials from which to make pads, the presently preferred material being silicone rubber with a durometer hardness of about 70 A shore. Other materials and/or hardness may, of course, be used in particular applications. The pads are retained on the jaws by a suitable cement. Graspable handles 15 and 16 are attached to the jaws so as to enable the musician to actuate the jaws by squeezing. The handles are preferably made integral with the jaws, but are not necessarily so. The jaws may be fabricated from metal, plastic, or other materials, as desired. For explanatory purposes, the graspable handles 15 and 16 are discussed here as items separate from the jaws 10 and 11. Persons skilled in the art will realize, however, that there is no clear demarcation between jaw and handle, i.e., that the handles are, in actuality, a part of the jaws, and indeed, as mentioned above, the jaws/handles may be (and preferably are) of unitary construction.

Spring assembly 17 (as will be described further below) exerts a force on the jaws and urges them toward each other.

Figure 6:
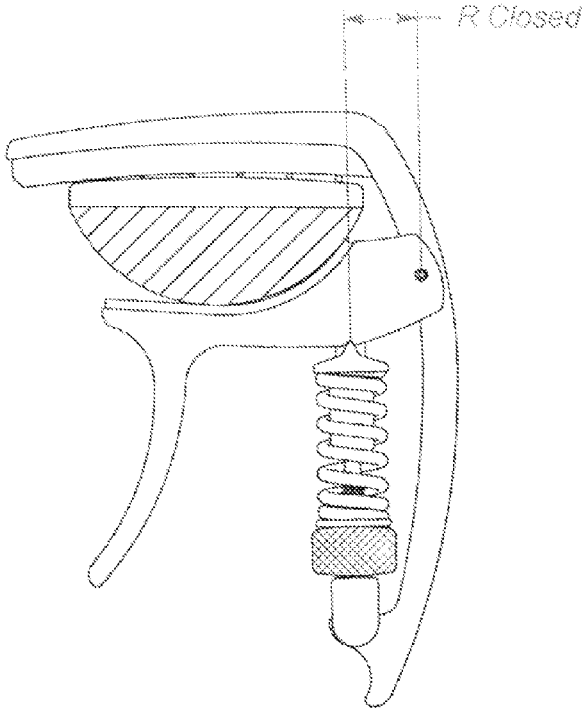
FIG. 6 is a side view of the first embodiment of the invention, shown closed, with the neck of an instrument shown clamped between its jaws.

FIG. 6 shows the neck of a typical stringed musical instrument being clamped by a capo according to the first embodiment of the invention. As shown in FIG. 6, the fixed jaw 10 clamps the strings against the fretboard, while the movable jaw 11 clamps the back of the instrument neck. This arrangement can be reversed (i.e., jaw 10 can be made the movable jaw, and jaw 11 the fixed jaw) simply by making the face of jaw 11 conform to the shape of the instrument fretboard, and jaw 10 conform to the shape of the back of the instrument neck. When in place, then, the handles will extend out on the fretboard side of the instrument (in the case of a capo similar to the first embodiment).

Figure 4:
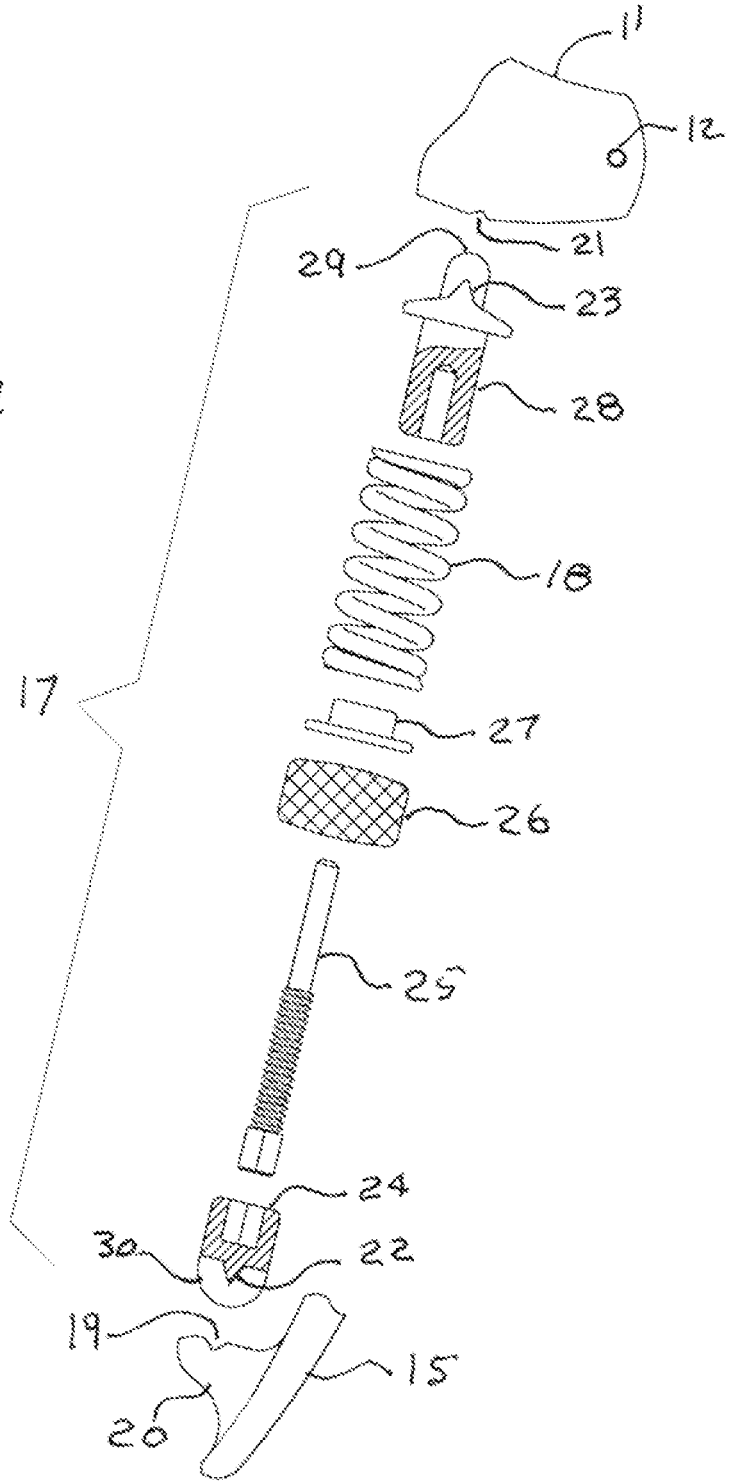
FIG. 4 is an exploded view of the spring assembly used in both embodiments of the invention described in this disclosure.

FIG. 4 shows an exploded view of a spring assembly 17 that provides the clamping force for the capo. The preferred embodiments described in this disclosure use a helical compression spring (18), but other types of spring could be used instead, such as multiple-disk springs, or torsion springs, for example. The spring, of whatever type is used, exerts its force between a "V" groove 19 in ear 20 at the bottom of handle 15 and a "V" groove 21 in jaw 11. The male "V"s on the spring assembly are "V" point 22 and "V" point 23. The remaining parts in the spring assembly are bottom cap 24, screw 25, adjusting nut 26 lower collar 27 and upper collar 28. Adjusting nut 26 is used to adjust the force of the capo on the strings to be as desired (when clamped in playing position and/or when being held open). Nubbin 29 extends into a groove in the bottom of jaw 11 so as to keep "V" point 23 in position (laterally). Skirts 30 accomplish a similar function with respect to "V" point 19.

Figure 5:
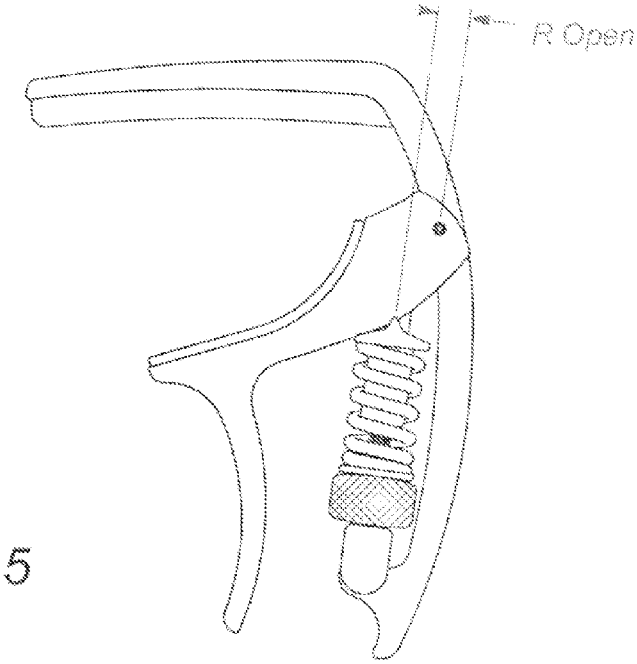
FIG. 5 is a side view of the first embodiment of the invention, shown in an open position.

FIGS. 5 and 6 show the capo both open, i.e., free of the instrument neck, (FIG. 5) and closed, i.e., clamped on an instrument neck, (FIG. 6). It can be seen that because of the location of the "V" grooves 19 and 21, the path of spring force is different with respect to the pivot 12, depending on the position of jaw 11, passing closer to the pivot 12 when the capo is open compared to when it is closed (R Open vs. R Closed). Or, to put it another way, as the jaws open, the lever arm, R, at which the spring force acts, gets smaller. The term "lever arm" (R) means the perpendicular distance between the pivot and the path of spring force. It will be recognized by those skilled in the art that if the angle between the line from pivot 12 to V groove 21 and the force axis of the spring is approximately a right angle when the capo is closed on an instrument neck, the path of spring force will not change much as the capo is opened, and the closing moment generated by spring 18 will be substantially a constant value (a constant lever arm) times the spring force. However, if the closed angle is obtuse, the angle will get even more obtuse as the capo is opened, and the path of spring force will move significantly as the capo is opened. The moment will correspondingly be a decreasing value (a decreasing lever arm) times the spring force. By choosing the location of the V grooves appropriately, the net capo closing moment can be made to even decrease as the capo is opened. In one example of a capo made according to the above description, R Open/R Closed was about 0.65.

Figure 9:
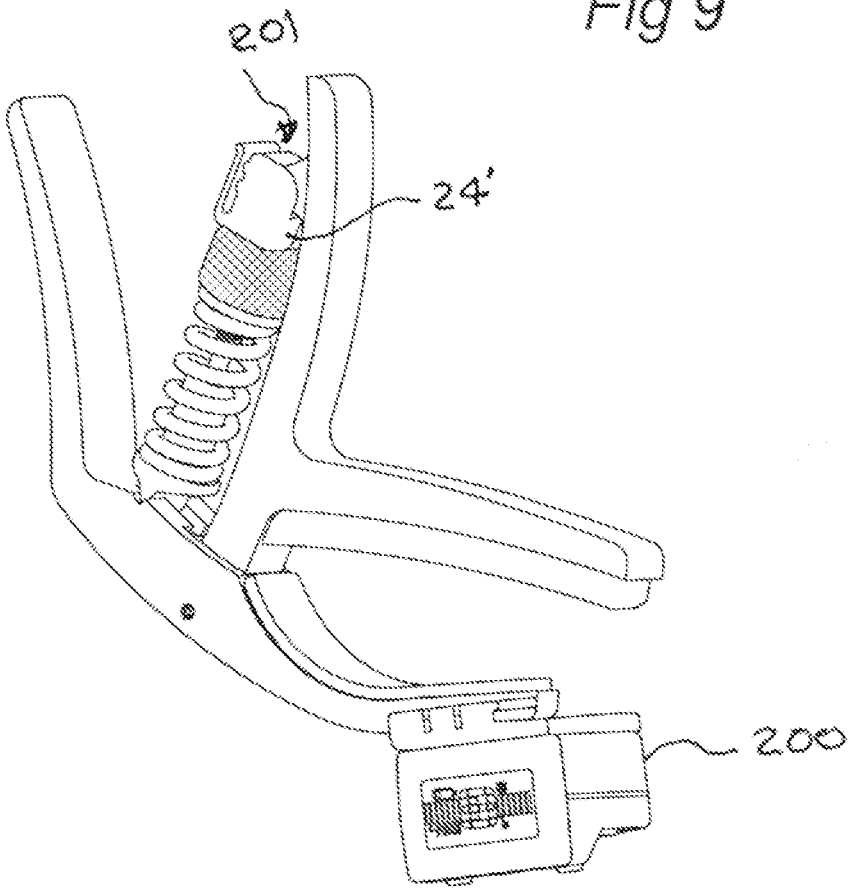
FIG. 9 is a perspective view of the second embodiment of the invention, shown with a tuner attached to one of its jaws.

FIGS. 7, 8, and 9 depict a second embodiment of the invention. Again, the arbitrary convention is used of calling the jaw that presses against the strings the "fixed" jaw (110), and the jaw that presses against the back of the neck (111) the "movable" jaw. The same or a similar spring assembly 17 may be used in both embodiments. As in the first embodiment described above, the angle between the line connecting pivot 112 and "V" groove 121 and the force axis of the spring (the line between V 22 and V 23) is obtuse, when an instrument neck is clamped by the capo. And, of course, the angle gets more obtuse as the capo is opened. As noted above, this arrangement causes R open to be significantly less than R closed, resulting in a decreasing of the opening force as the capo is opened, as compared to the case when R open and R closed are about the same.

Again, the jaw functions can be interchanged by simply changing the shapes of their faces so that jaw 111 can clamp the strings, and jaw 110 can clamp the instrument neck.

FIG. 9 shows a perspective view of the second embodiment of the invention with a tuner 200 attached to jaw 111 and bottom cap 24 modified to include a pick holder 201. The modified bottom cap is numbered 24'. Since the string vibrations in an instrument of the type that can use a capo are always coupled to the neck, a tuner mounted on one of the jaws of the capo will provide a reliable and convenient reading of string frequencies. And, the inclusion of a pick holder is a convenience for the musician.

Figure 10:
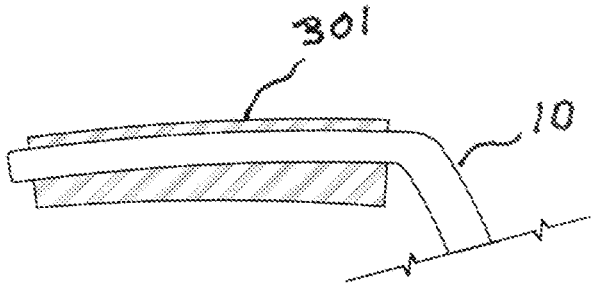
FIG. 10 is a fragmentary cross sectional view of one of the jaws of the first embodiment with a first alternative pad installed.
Figure 11:
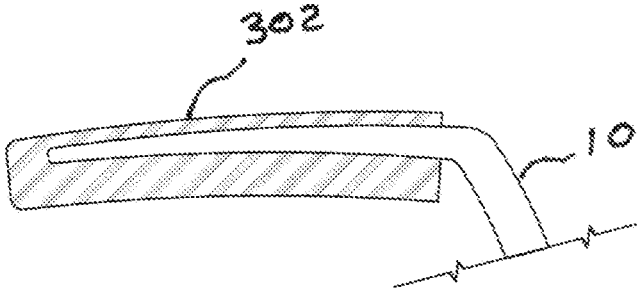
FIG. 11 is a fragmentary cross sectional view of one of the jaws of the first embodiment with a second alternative pad installed.

The strings of a stringed musical instrument are of relatively small diameter, and are under relatively great tension. They therefore tend to cause wear on the pads that are used to face the jaws. Accordingly, it is desirable that the pads be easily replaced. FIGS. 10 and 11 depict two types of pad that can be installed by a user of the instrument, without tools or the use of cement. The replaceable pads (301 and 302) are shown installed on the jaw 10 of the first embodiment of the invented capo (as illustrated in FIGS. 1-6). FIG. 10 shows a pad 301 that has been extruded from, for example, silicone rubber that has been simply stretched (slightly) over the jaw 10 of a capo. FIG. 11 shows a molded pad 302 that fits over the jaw 10, and is again retained by the elastic forces of the material from which it is made. In neither case is cement or other external means required to retain the pads.

Persons having skill in the art will recognize that while two embodiments of the invention have been disclosed here, the principles of the invention, as defined by the claims, may be applied by other embodiments as well. For example, while the invention has been illustrated using a compression spring, the invention can also be practiced, within the spirit of the claims, using an extension spring. And, as has been mentioned earlier, spring forms other than helical wound springs are also possible and contemplated. Such modifications, and others as will occur to those skilled in the art, are intended to be covered by the claims.

I claim:

1. A capo comprising:

a first jaw;

a second jaw;

a pivot coupling directly or indirectly said first jaw to said second jaw whereby said jaws are rotatably movable with respect to each other from a closed position to an open position;

first and second graspable arms, connected to said first and second jaws respectively, said first and second graspable arms being arranged whereby a squeezing action applied thereto will cause said jaws to move from said closed position toward said open position;

a spring coupled directly or indirectly to said jaws such that it exerts a closing force that acts on said jaws, wherein the perpendicular distance to said pivot from a straight line passing through the ends of said spring becomes smaller as said jaws open.

2. A capo as recited in claim 1 wherein said spring is a helical compression spring, one end being coupled directly or indirectly to said first jaw, and the second end being coupled directly or indirectly to said second jaw.

3. A capo as recited in claim 2 and further including a threaded nut for adjusting the force exerted by said spring.

4. A capo as recited in claim 1 and further including an elastomeric pad covering at least said first jaw, said elastomeric pad being retained on said jaw by elastic forces without the use of cements.

5. A capo as recited in claim 4 where said elastomeric pad is comprised of a length of extruded elastomer in the shape of a tube.

6. A capo as recited in claim 4 where said elastomeric pad is comprised of a molded tubular section with one end closed.

7. A capo as recited in claim 1 and further including a tuner attached to one of said jaws.

8. A capo as recited in claim 1 and further including a pick holder attached to one of said jaws.

9. A capo as recited in claim 1 wherein said graspable arms are a part of or are rigidly connected to said jaws.

10. A capo comprising:

a first jaw;

a second jaw;

a pivot pivotally coupling directly or indirectly said first jaw to said second jaw, said jaws being movable between a closed position and an open position;

first and second graspable arms, each a part of or rigidly connected to said first and second jaws respectively, said first and second graspable arms being arranged whereby a squeezing action a applied thereto will cause said jaws to move from said closed position toward said open position;

a spring exerting a force that acts between said first and said second jaws, said force being exerted between a first pivoting point and a second pivoting point, said first pivoting point being coupled directly or indirectly to either said first jaw or said first graspable arm, and said second pivoting point being coupled directly or indirectly to either said second jaw or said second graspable arm.

11. A capo as recited in claim 10, where the triangle formed by lines drawn between said pivot and said first and said second pivoting points is an obtuse triangle when said jaws are in said closed position.

12. A capo as recited in claim 11 where the obtuse angle of said obtuse triangle becomes even more obtuse when said jaws are moved toward said open position.

* * * * *